United States Patent [19]

Nakajima

[11] Patent Number: 4,938,458

[45] Date of Patent: Jul. 3, 1990

[54] CONTINUOUS ION-CARBURIZING AND QUENCHING SYSTEM

[75] Inventor: Yujiro Nakajima, Osaka, Japan

[73] Assignee: Chugai Ro Co., Ltd., Osaka, Japan

[21] Appl. No.: 452,383

[22] Filed: Dec. 19, 1989

[30] Foreign Application Priority Data

Dec. 22, 1988 [JP] Japan ..... 63-165983[U]

[51] Int. Cl.[5] ..... C21D 1/74

[52] U.S. Cl. ..... 266/250; 148/16.5; 266/249

[58] Field of Search ..... 266/249–251; 148/16.5

[56] References Cited

U.S. PATENT DOCUMENTS

| | | | |
|---|---|---|---|
| 4,019,064 | 4/1977 | Michel | 148/16.5 |
| 4,342,918 | 8/1982 | Tanaka | 266/250 |
| 4,853,046 | 8/1989 | Verhoff | 148/16.5 |

*Primary Examiner*—Peter D. Rosenberg

*Attorney, Agent, or Firm*—Wenderoth, Lind & Ponack

[57] ABSTRACT

A heating process, a carburizing process and a diffusion process are successively carried out in a continuous ion-carburizing and quenching system, which is provided with a rotary hearth type continuous ion-carburizing furnace and a continuous diffusion furnace disposed adjacent to the ion-carburizing furnace. The ion-carburizing furnace is provided with a charge vestibule and a discharge vestibule while the diffusion furnace is provided with a charge vestibule and a quenching chamber. The discharge vestibule of the ion-carburizing furnace is connected to the charge vestibule of the diffusion furnace by a transfer vestibule so that a material to be treated may be transferred from the ion-carburizing furnace towards the diffusion furnace through the transfer vestibule. An airtight door is disposed midway of the transfer vestibule for partitioning the discharge vestibule of the ion-carburizing furnace and the charge vestibule of the diffusion furnace from each other.

2 Claims, 2 Drawing Sheets

CONTINUOUS ION-CARBURIZING AND QUENCHING SYSTEM

BACKGROUND OF THE INVENTION

1. Field of the Invention

The present invention relates to a continuous ion-carburizing and quenching system.

2. Description of the Prior Art

The Japanese Patent Laid-open Application No. 52-131936 discloses an ion-carburizing system, in which materials are batch-treated by the use of an ion-carburizing method.

However, when such an ion-carburizing system is directly coupled with a machinery processing line, it is necessary to temporarily store the materials. Because of this, a certain storage space is required.

Furthermore, the batch-treatment requires trays or the like, on which a number of materials are placed. In addition, since the materials are not brought into uniform contact with carburizing gas, they are occasionally unevenly carburized.

SUMMARY OF THE INVENTION

Accordingly, the present invention has been developed with a view to substantially eliminating the above described disadvantages inherent in the prior art ion-carburizing system, and has for its essential object to provide a continuous ion-carburizing and quenching system which never requires a space for temporarily storing materials to be treated and is capable of conducting substantially uniform carburizing treatment.

In accomplishing this and other objects, a continuous ion-carburizing and quenching system according to one preferred embodiment of the present invention comprises a rotary hearth type continuous ion-carburizing furnace provided with a charge vestibule and a discharge vestibule disposed adjacent to each other, a continuous diffusion furnace disposed adjacent to the ion-carburizing furnace and provided with a charge vestibule and a quenching chamber, and a transfer vestibule for connecting the discharge vestibule of the ion-carburizing furnace with the charge vestibule of the diffusion furnace so that a material to be treated may be transferred from the ion-carburizing furnace towards the diffusion furnace through the transfer vestibule. An airtight door is disposed midway of the transfer vestibule for partitioning the discharge vestibule of the ion-carburizing furnace and the charge vestibule of the diffusion furnace from each other.

The above described construction enables ion-carburizing treatment including a heating process, a carburizing process and a diffusion process to be successively carried out.

BRIEF DESCRIPTION OF THE DRAWINGS

This and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
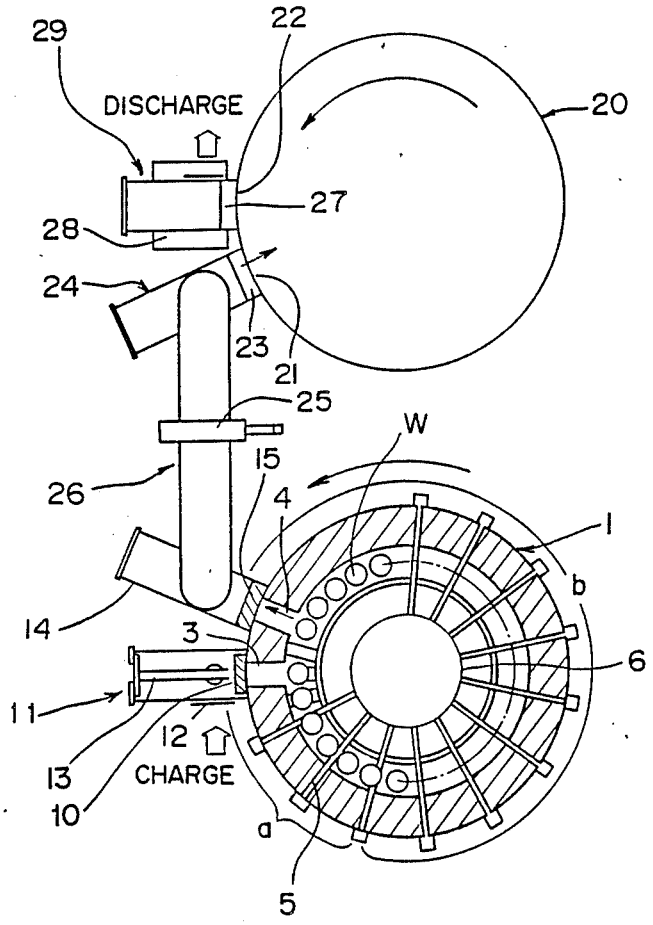
FIG. 1 is a top plan view, partly in section, of a continuous ion-carburizing and quenching system according to a first embodiment of the present invention.
Figure 2:
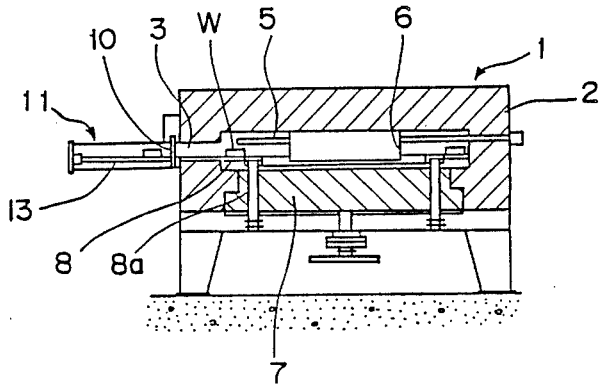
FIG. 2 is a vertical sectional view of a carburizing furnace in the system of FIG. 1.

Referring now to the drawings, there is shown in FIGS. 1 and 2, an ion-carburizing and quenching system according to a first embodiment of the present invention, which is comprised of a rotary hearth type continuous ion-carburizing furnace 1, a continuous diffusion furnace 20 disposed adjacent to the ion-carburizing furnace 1 and a material transfer vestibule 26 for connecting the ion-carburizing furnace 1 with the diffusion furnace 20.

The ion-carburizing furnace 1 is comprised of a furnace housing 2 and a rotary hearth 7. The furnace housing 2 is provided with a first charge opening 3 and a first discharge opening 4 formed adjacent to each other. A heating zone (a) and a carburizing zone (b) are formed between the first charge opening 3 and the first discharge opening 4 in this order in a direction of rotation of the rotary hearth 7. A plurality of heating means 5 of SiC (silicon carbide) heating elements or the like are radially disposed on a ceiling of the heating zone (a) and that of the carburizing zone (b). An anode plate 6 is disposed at a central portion of the furnace 1. The heating means 5 may be further provided on a side wall of the furnace 1.

The rotary hearth 7 is provided with a plurality of insulating supports 8*a*, on which radially extending material tables 8 are securely mounted. Each table 8 is also used as a cathode.

A first charge vestibule 11 is provided in front of the first charge opening 3 and both of them can be partitioned by a thermal insulating airtight door 10. The first charge vestibule 11 is provided with a charge door 12 and a charging means 13 of fork mechanism, which can move back and forth with respect to the first charge opening 3. A first discharge vestibule 14 is provided in front of the first discharge opening 4 and both of them can be partitioned by a thermal insulating airtight door 15. The first discharge vestibule 14 is provided with a discharging means (not shown).

Like the ion-carburizing furnace 1, the diffusion furnace 20 is comprised of a furnace housing and a rotary hearth. The furnace housing is provided with a second charge opening 21 and a second discharge opening 22 formed adjacent to each other.

A second charge vestibule 24 accommodating a discharging means (not shown) is provided in front of the second charge opening 21 and both of them can be partitioned by a thermal insulating airtight door 23. The second charge vestibule 24 and the first discharge vestibule 14 are connected to each other through the material transfer vestibule 26. An airtight door 25, which can partition both the vestibules 14 and 24 from each other, is disposed midway of the material transfer vestibule 26.

A quenching chamber 29 provided with a quenching tank 28 and a material immersion means (not shown) is provided in front of the second discharge opening 22. The quenching chamber 29 and the second discharge opening 22 can be partitioned by a thermal insulating airtight door 27.

Figure 3:
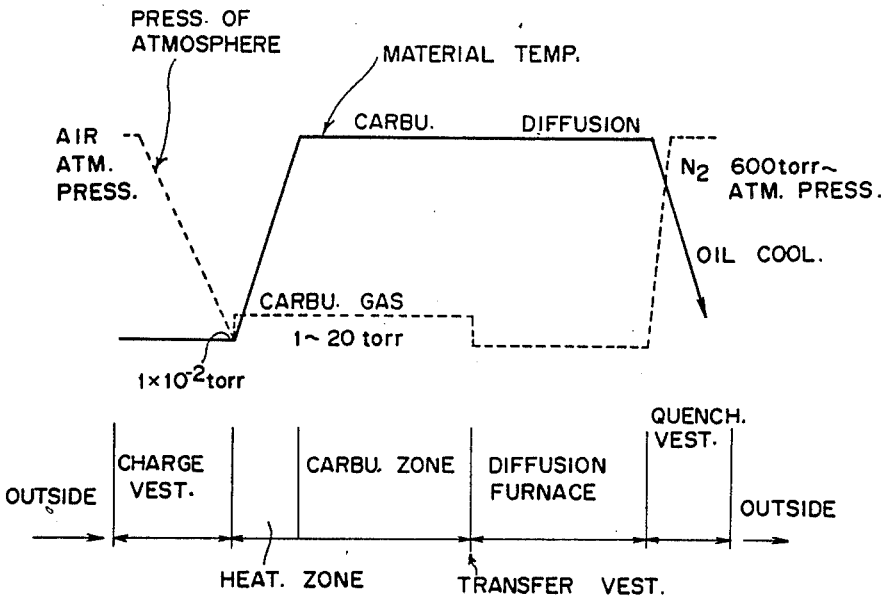
FIG. 3 is a graph indicative of the relationship between temperatures and pressures at various locations in the system of FIG. 1.

The operation of the continuous ion-carburizing and quenching system having the above described construction will be explained hereinafter with reference to FIG. 3.

A material W is initially charged into the first charge vestibule 11, which is then evacuated so that the pressure inside the first charge vestibule 11 may be reduced to a pressure of approximately $1\times10^{-2}$ Torr (mmHg). The first charge vestibule 11 is thus purged under reduced pressure and the material W is placed on a table 8 of the rotary hearth 7 by the charging means 13. Upon intermittent rotation of the rotary hearth 7, the material W is heated up to a carburizing temperature in the heating zone (a). When the material W reaches the carburizing zone (b), carburizing gas is ionized by glow discharge between the table 8 and the anode plate 6 so that the material W may be ion-carburized. Hydro carbon gas is generally used as the carburizing gas. During these heating and carburizing processes, the pressure of the carburizing as in the heating zone (a) and the carburizing zone (b) is kept between 1 and 20 Torr.

Upon completion of the carburizing process, the material W is discharged into the first discharge vestibule 14. Thereafter, the material W is charged into the second charge vestibule 24 through the material transfer vestibule 26 and placed on the rotary hearth of the diffusion furnace 20. This rotary hearth rotates intermittently as well as the rotary hearth 8 of the carburizing furnace 1. The material W undergoes diffusion treatment under a reduced pressure of 1 to 20 Torr during almost one rotation thereof inside the furnace. Although the diffusion treatment is conducted under a reduced pressure in this embodiment, this treatment may be conducted in $N_2$ atmosphere gas or endothermic atmosphere gas.

Subsequently, the material W is introduced into the quenching chamber 29 through the second discharge opening 22. After the material W has been quenched in the quenching chamber by any known method, it is taken out of the furnace. During this quenching process, the quenching chamber 29 is filled with $N_2$ gas and kept at a pressure of 600 Torr to the atmospheric pressure.

Although the carburizing furnace 1 and the diffusion furnace 20 are arranged on the same level in the foregoing embodiment, they may be arranged in three dimensions.

Figure 4:
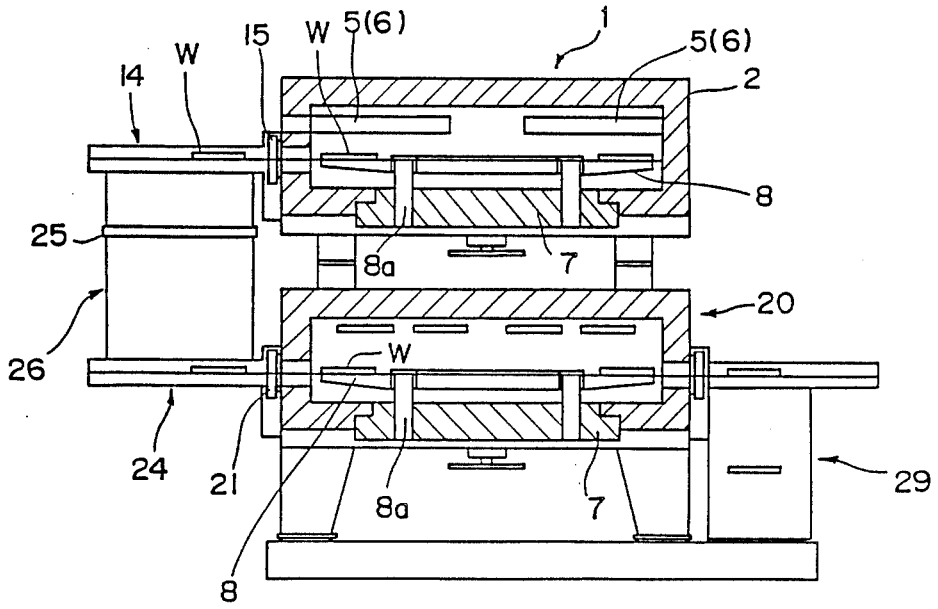
FIG. 4 is a vertical sectional view of a continuous ion-carburizing and quenching system according to a second embodiment of the present invention.

More specifically, as shown in FIG. 4 which particularly shows a system according to a second embodiment of the present invention, a carburizing furnace 1 is securely mounted on a diffusion furnace 20. In this embodiment, a material W is introduced into a carburizing furnace 1 through a first charge vestibule (not shown). Upon the heating and carburizing, the material W is discharged into a first discharge vestibule 14 and charged into the diffusion furnace 20 through a material transfer vestibule 26 accommodating a lifting means. Upon completion of the diffusion, the material W is quenched in a quenching chamber 29. It is noted that heating means 5 disposed in the carburizing furnace 1 is comprised of radiant tubes, each of which serves also as an anode.

As shown in FIG. 4, the construction of the diffusion furnace 20 is substantially similar to that of the carburizing furnace 1.

The system according to the second embodiment can reduce its installation space, as compared with the system according to the first embodiment.

It is noted that the rotary hearth type diffusion furnace 20 can be replaced by any other furnace which is capable of continuously treating the material W.

As is clear from the above, according to the present invention, even when materials are transported at regular intervals in a machinery processing line, the materials can be successively carburized without temporarily storing them in a certain storage space. Accordingly, the system according to the present invention never requires the storage space for the materials, thus resulting in reduced installation space.

Furthermore, since the materials .travel within furnaces throughout the whole treatment, they are in uniform contact with surrounding atmosphere. Because of this, the materials are hard to be unevenly carburized.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A continuous ion-carburizing and quenching system comprising:

a rotary hearth type continuous ion-carburizing furnace provided with a charge vestibule and a discharge vestibule disposed adjacent to each other;

a continuous diffusion furnace disposed adjacent to said ion-carburizing furnace and provided with a charge vestibule and a quenching chamber;

a transfer vestibule for connecting said discharge vestibule of said ion-carburizing furnace with said charge vestibule of said diffusion furnace so that a material to be treated is transferred from said ion-carburizing furnace towards said diffusion furnace through said transfer vestibule; and an airtight door disposed midway of said transfer vestibule for partitioning said discharge vestibule of said ion-carburizing furnace and said charge vestibule of said diffusion furnace from each other.

2. The system according to claim 1, wherein said diffusion furnace is a rotary hearth type furnace.

* * * * *